US005569127A

United States Patent [19]

Johnston

[11] Patent Number: 5,569,127

[45] **Date of Patent: * Oct. 29, 1996**

[54] SIDE STEPPING EXERCISE APPARATUS

[76] Inventor: Gary L. Johnston, P.O. Box 183, Cowarts, Ala. 36321

[ * ] Notice: The portion of the term of this patent subsequent to Nov. 12, 2013, has been disclaimed.

[21] Appl. No.: 215,040

[22] Filed: Mar. 21, 1994

Related U.S. Application Data

[63] Continuation-in-part of Ser. No. 151,178, Nov. 12, 1993, abandoned.

[51] Int. Cl.[6] ..... A63B 21/02; A63B 23/04

[52] U.S. Cl. ..... 482/52; 482/80

[58] Field of Search ..... 482/51, 52, 53, 482/79, 80, 57, 58, 63–65

[56] References Cited

U.S. PATENT DOCUMENTS

| | | | |
|---|---|---|---|
| 2,079,594 | 5/1937 | Clem | 482/53 |
| 4,720,093 | 1/1988 | Del Mar | 482/52 |
| 4,900,012 | 2/1990 | Fu | 482/52 |
| 5,267,922 | 12/1993 | Robinson | 482/52 |
| 5,279,530 | 1/1994 | Hess | 482/79 |

*Primary Examiner*—Stephen R. Crow

[57] ABSTRACT

A side stepping exercise apparatus is provided which a user operates while in a standing position. The apparatus includes a foot engagement assembly mounted on a frame structure. The foot engagement assembly comprises two foot engaging members which are coupled to the frame structure to move in a substantially vertical direction. Two force transmitting components operatively connect the frame structure and the foot engagement assembly. One force transmitting components operatively connects the front of the frame structure and the front of the foot engaging members. A second force transmitting component operatively connects the rear of the frame structure with the rear of the foot engaging members. The two connections are such that a downward force applied to one portion of the foot engaging members produces an upward force on the corresponding portion of the other foot engaging member. This causes the foot engaging members to move in opposite direction from one another. A handle member may be coupled to the device for user interface. Also, a resistance device may be connected to the foot engaging members to provide a resistance to motion. Alternately, a motor may be connected to the foot engaging members to provide for automatic movement.

20 Claims, 8 Drawing Sheets

SIDE STEPPING EXERCISE APPARATUS

CROSS-REFERENCED TO RELATED APPLICATIONS

This application is a continuation-in-part of U.S. application Ser. No. 08/151,178, entitled "Elevating Exercise Apparatus", filed Nov. 12, 1993, now abandoned.

BACKGROUND OF THE INVENTION

1. Field of the Invention

This invention relates to a lower body exercise device and in particular to an exercise device upon which the user, while in a standing position, pushes downward upon one side of the device with their foot, causing the opposite foot to be elevated in a substantially vertical direction, with both feet of the user remaining in a substantially horizontal position. The user then pushes the elevated foot downward upon the device, thereby producing upward movement of the previously down foot, again in the substantially vertical direction and occurring with the feet of the user remaining in a substantially horizontal position. This action is repeated back and forth to provide a side stepping type or exercise routine not found in current lower body exercise devices.

The user pushes downward upon foot rest members to create the described motion and, for all practical purposes, will not be able to or may not want to stand at the exact center of the foot rest member. Therefore it is desireable to have the foot rest members moveably supported and guided at both the front and rear ends, since a moment will be introduced in the foot rest from this downward force. A power translating mechanism would transmit this user created downward force into upward forces acting upon the other foot rest member at its guided ends. This would also be true for any externally induced forces, such as those supplied by a resistance means or a motor means. Having each foot rest member supported and guided at each end and having forces transmitted to the foot rest also at each end allows for easier foot rest movement and thus creates a more balanced device.

2. Description of the Prior Art

Presently there exists many variations of lower body exercise devices which utilize a type of stepping motion. These include stair-stepper machines and treadmills. While these units offer relatively good lower body exercise routines, they all appear to be one dimensional. Stair-stepper machines usually have a foot rest member pivotally mounted to the frame, with the user having to step downward at an angle to perform the desired exercise routine. The motion of the user is therefore at an angle, not in a true upward and downward direction. Some stair-stepping devices do have foot rest members which move with the position of the feet, but the feet do not maintain a substantially horizontal position at all times and do not move in a substantially vertical direction. Treadmills only offer a type of walking or jogging step motion, in which the user only feels resistance when their foot contacts the belt surface. In addition, there is prior patented art, cited in the parent application of which this application is a continuation-in-part, which show stepping exercise devices which utilizing a foot rest member. The foot rest members are not pivotally connected to the frame, but move along a guided path. These include:

U.S. Pat. No. 4,842,268 to Jenkins demonstrates an exercise device having foot rest members moving in opposite upward and downward direction through a drive belt and pulley type of power translating mechanism. Each foot rest member is supported at its proximate center by a support member which extends from one side to the other. The foot rest member is mounted to a guide means located along its side.

U.S. Pat. No. 4,958,830 to Huggins et al. demonstrates an exercise device having foot rest members moving in opposite upward and downward directions, slightly angled, through a combined chain, sprocket and lever type of power translating mechanism. Each foot rest member is supported at its proximate center by a support member which extends from one side to the other. The foot rest member is mounted to a guide means located along its side.

U.S. Pat. No. 5,199,932 to Liao demonstrates an exercise device having foot rest members moving in opposite upward and downward directions, slightly angled, through a hydraulic type of power translating mechanism. Each foot rest member is supported at its proximate center by a support member which extends from one side to the other. The foot rest member is mounted to a guide means located along its side.

G.B. Patent No. 2,010,101 to Hickman demonstrates an exercise device having foot rest members moving in opposite upward and downward direction, along an angle, through a roller and strap type of power translating mechanism. Each foot rest member is supported and guided along both sides.

U.S. Pat. No. 4,676,501 to Hoagland et al. demonstrates an exercise device having foot rest members moving in opposite upward and downward directions through an electric motor and lever type of power translating mechanism. Each foot rest member is supported and guided along both sides.

U.S. Pat. No. 4,900,012 to Fu demonstrates an exercise device having foot rest members moving independently in the upward and downward direction utilizing a spring type of power translating mechanism. Each foot rest member is supported and guided along both sides.

U.S. Pat. No. 5,267,922 to Robinson demonstrates an exercise device having foot rest members moving in opposite upward and downward directions, at an angle, through a pulley and cable type of power translating mechanism. Each foot rest member is supported and guided along its front end.

U.S. Pat. No. 2,079,594 to Clem demonstrates an exercise device having foot rest members moving in opposite upward and downward directions through a hydraulic type of power translating mechanism. Each foot rest member is supported and guided along its front end.

U.S. Pat. No. 4,786,050 to Geschwender demonstrates an exercise device having foot rest members moving in opposite circular motion, slightly slanted, through a pulley, belt and lever type of power translating mechanism. Each foot rest member is supported and guided at the front and rear of one side.

None of the above inventions and patents, taken either singly or in combination, is seen to describe the instant invention as claimed. Jenkins, Huggins et al., and Liao demonstrate similar exercise device which have foot rest members supported and guided along one side. Hickman, Hoagland, and Fu demonstrates exercise devices which have foot rest members supported and guided along both sides. Robinson and Clem demonstrate exercise devices which have foot rest member supported and guided along the front ends. Geschwender demonstrates an exercise device having foot rest members supported and guided along the side, at both the front and rear ends. However, none of these devices have a foot rest member supported and guided at both the front and rear ends. With the exception of Hoagland and Clem, all of the above mention prior art have foot rest members guided along a slanted path. With the exception of Geschwender, none of the prior art have a power translating mechanism which translates power to each end of the foot rest member.

The exercise device described in this application demonstrates foot rest members which are guided and supported along both the front and rear ends. These supports and guides allow the foot rest members to move in a substantially vertical direction while maintaining a substantially horizontal position. A power translating mechanism is used to produce the opposite upward and downward movement of the respective foot rest members through a transfer of force. The downward force exerted by the user as he steps downward upon one of the foot rest members is transmitted into an upward force upon the second foot rest members. All forces either act on or against the front and rear ends of the foot rest members, as close to the guide-support members as possible.

Having these forces exerted on the foot rest members at each end and close to the guide/support members as opposed to only at one end or to the side creates a more sturdy and balanced movement of the foot rest members. If the forces were exerted only at one end or at the side, the weight of the user would create a moment about this point. This moment would greatly inhibit the ability of the foot rest members to move upward or downward along the guide/support members, since the frictional forces against the guide/support members would be significantly increased. Therefore, it is best to have forces exerted at both ends to minimize the amount of frictional force exerted by the guide/support members.

With the forces being applied to each end of the foot engaging members and the members also being supported and guided at each end, the user is able to perform forward and backward stepping routines, with the feet being positioned at different alignments. This would be difficult to perform on those devices seen in the prior art and being marketed today, since these have power translating mechanism which apply forces to only one end or to the sides, with only this one end or the sides being guided. Given the fact that there are vast number of exercise devices on the market today, it has come as a surprise that no one has effectively designed a device upon which the user may perform this type of side stepping exercise routine.

SUMMARY AND OBJECTS OF THE INVENTION

It is the object of this invention to provide a stepping device which is comfortable, easy, and safe to operate while in a standing position. One version may allow for manual operation of the device, with the upward and downward stepping motion being induced by the user. A second version of the device may allow for automatic operation of the device whereby the upward and downward stepping motion is induced by a motor. Both of these features will offer a better and more versatile workout than found on current stepper and treadmill type exercise devices.

It is the further object of this invention to provide a lower body exercise device which may include a handle member for use in maintaining proper balance. The handle may also be used in conjunction with the feet to operate the device, thereby allowing the user to exercise both upper and lower body muscle groups. The handle member may also be adjustable to compensate for various user heights.

Briefly stated, the apparatus that forms the basis of the present invention comprises basically a structural frame means, a foot engagement means, and a power translating mechanism. The power translating mechanism comprises a shaft member and two force transmitting means. The device may also include a hand engagement means which may be used for balancing purposes, or may be used in conjunction with the foot engagement means for operating the device. The device may also include a resistance means which may operate in conjunction with the power translating mechanism. This would be for manual operation of the device. Another version of the device may include a motor means for automatic operation.

The structural frame means may include support members which form a strong support base. The foot engagement means and the power translating mechanism mount upon this frame. The hand engagement means may also mount upon the frame or may mount upon the foot engagement means, whichever is preferred.

As stated previously, a resistance means may be included for manual operation of the device. It may mount as a separate component on the frame and connect to the power translating mechanism. It would operate in conjunction with the foot engagement means to provide a force against the user during the side stepping motion. The amount of resistance may be adjustable to provide the desired resistance force. Instead of a resistance means, a motor means may mount as a separate component upon the frame and connect to the power translating mechanism for automatic operation of the device. The stepping motion of the device would be induced by the motor, not the user.

The apparatus may be configurable for different operating capabilities, with the frame and power translating mechanism being adjustable so that the user may vary their width of stance. Also, if a hand engagement handle is to be used, the handle may be upwardly and downwardly adjustable to compensate for different user heights. As previously stated, the hand engagement handle may be connected to the frame and used for balancing purposes, or it may be connected to the foot engagement means and used for upper body workout routines.

Also, a conventional exercise computer may be part of the apparatus. It will not be shown in the accompanying figures, but may connect to the foot engagement means or the power translating mechanism and keep track of exercise related data such as number of steps, time, calories, etc.

Other objects, features, and advantages for this invention will be apparent from the following detailed description and the appended claims, references being made to the accompanying drawings forming a part of the specification, wherein like reference numerals designate corresponding parts of several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

Figure 1A:
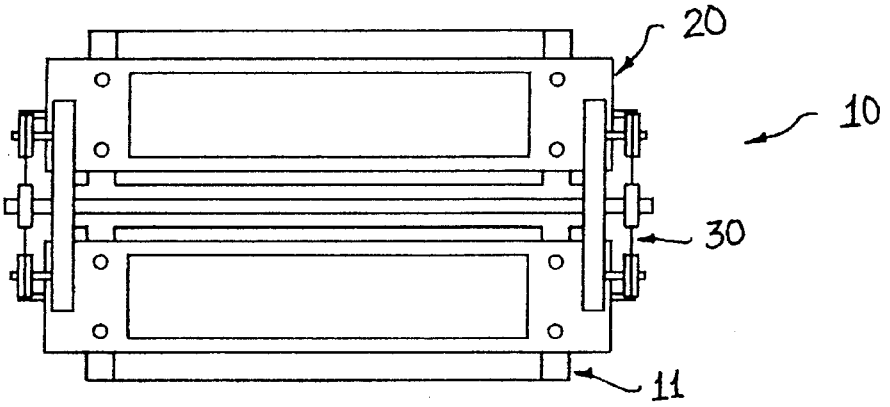
FIG. 1A is a top view of the side stepping exercise apparatus.
Figure 1B:
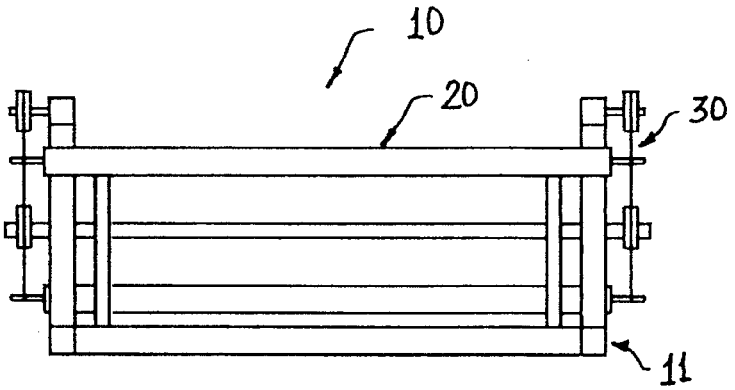
FIG. 1B is a side view of the side stepping exercise apparatus.
Figure 1C:
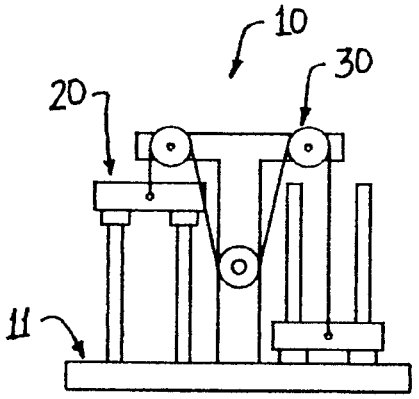
FIG. 1C is a front view of the side stepping exercise apparatus.
Figure 1D:
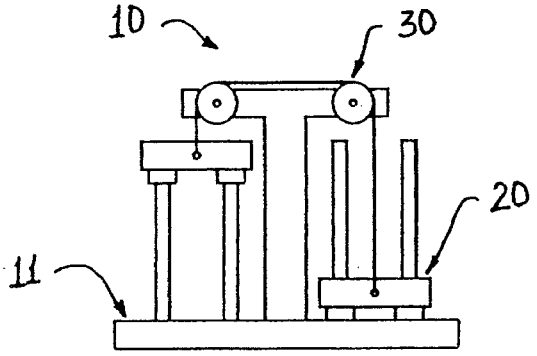
FIG. 1D is a front view of the side stepping exercise apparatus without a shaft member.

As best can be seen by references to the drawings, and in particular to FIGS. 1A, 1B, and 1C, the side stepping exercise apparatus that forms the basis for the present invention is designated generally by the references numeral 10. Side stepping exercise apparatus 10 basically comprises a structure frame means 11, a foot engagement means 20, and a power translating mechanism 30. FIG. 1D demonstrates the apparatus without the shaft member of the power translating mechanism 30.

Other components such as a hand engagement means, a resistance means, and a motor means may also be a part of the side stepping exercise apparatus 10. The hand engagement means may be used by the user for balancing purposes or as an upper body workout addition. The resistance means may be used to provide a resistance in the upward and downward movement of the foot engagement means 20 as indicated by the user during manual operation of the device. The motor means may be used to induce motion in the foot engagement means 20 during automatic operation of the device. Both of these features will be described later on in the specification.

Figure 2A:
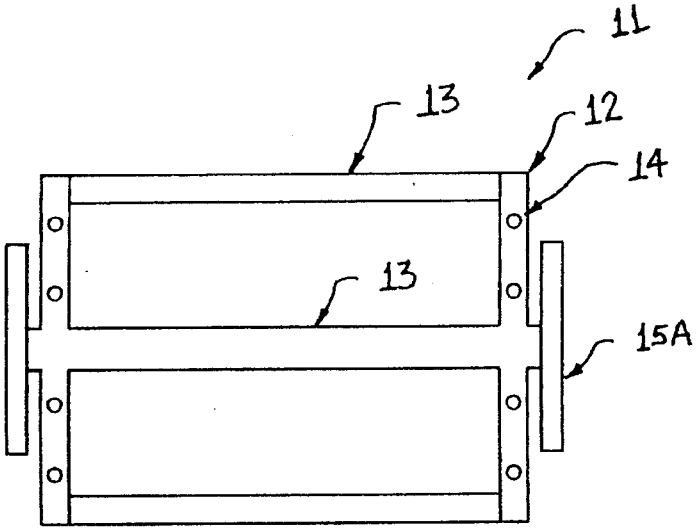
FIG. 2A is a top view of the structural frame means of the side stepping exercise apparatus.
Figure 2B:
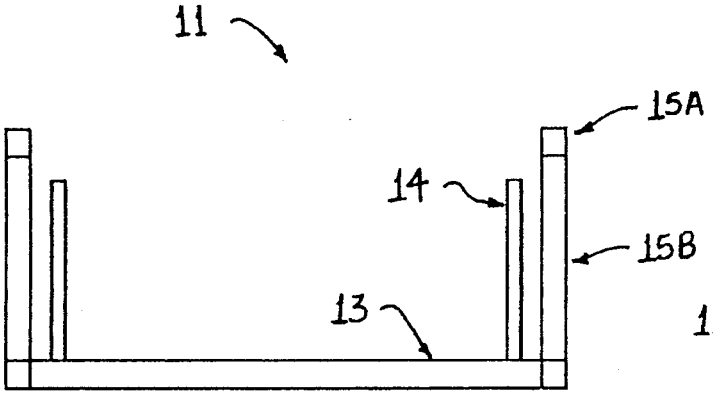
FIG. 2B is a side view of the structural frame means of the side stepping exercise apparatus.
Figure 2C:
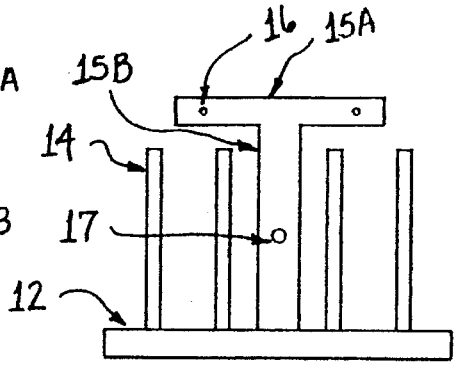
FIG. 2C is a front view of the structural frame means of the side stepping exercise apparatus.

Referring to FIGS. 2A, 2B, and 2C, structural frame means 11 comprises base support members 12, cross members 13, guide members 14, and mechanism mounts 15. Base support members 12 are elongated support structures used to support guide members 14 and mechanism mounts 15. One base support member 12 is located at the front and rear ends of the structural frame means 11. Cross members 13 are also elongated support structures which are used to connect the base support members 12. These create a more sturdy overall structure. Guide members 14 are mounted on base support members 12 and are upwardly extending support elements used to guide the foot engagement means 20 in a substantially vertical direction. The mechanism mounts 15 are used to support the various components of the power translating mechanism 30 and mount upon base support members 12. Each mechanism mount 15 has a horizontal support means 15A and a vertical support means 15B. The vertical support means 15B supports the horizontal support means 15A at its proximate center, and is rigidly connected to the base support members 12, one at each end of the frame. Each horizontal support means 15A has two axle openings 16, each located proximate above the guide members 14. Each vertical support means 15B may contain a shaft opening 17, if a shaft is to be utilized by the device.

Figure 3A:
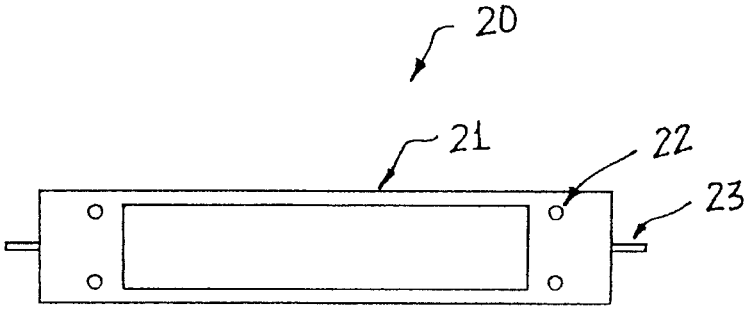
FIG. 3A is a top view of the foot engagement means of the side stepping exercise apparatus.
Figure 3B:
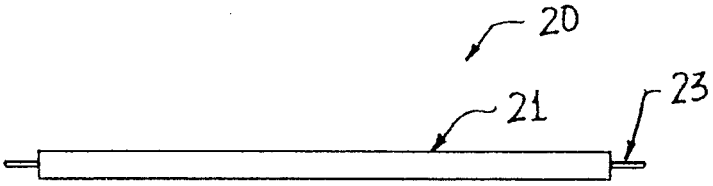
FIG. 3B is a side view of the foot engagement means of the side stepping exercise apparatus.
Figure 3C:
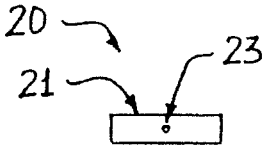
FIG. 3C is a front view of the foot engagement means of the side stepping exercise apparatus.
Figure 4A:
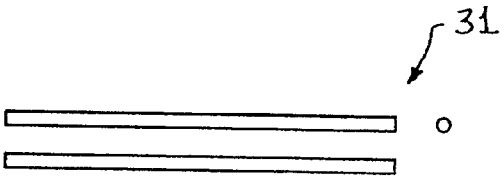
FIG. 4A is a top, side, and front view of the shaft member of the power translating mechanism of the side stepping exercise apparatus.
Figure 4C:
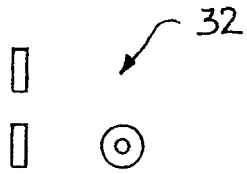
FIG. 4C is a top, side, and front view of the shaft rotatable member of the power translating mechanism of the side stepping exercise apparatus.
Figure 4B:
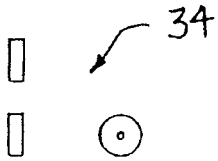
FIG. 4B is a top, side, and front view of the frame mounted rotatable member of the power translating mechanism of the side stepping exercise apparatus.
Figure 4D:
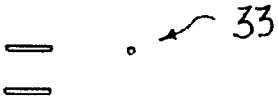
FIG. 4D is a top, side and front view of the axle member of the power translating mechanism of the side stepping exercise apparatus.

As may be seen in FIGS. 3A, 3B, and 3C, the foot engagement means 20 comprises foot engaging members 21 which are relatively flat structures upon which the user places their feet. Each foot engaging member 21 contains guide openings 22 at each end for receiving guide members 14 of structural frame means 11. Foot engaging members 21 also have rod-like foot member connectors 23 extending from each end, which are used to connect the foot engaging members 21 with the power translating mechanism 30.

Shown in FIGS. 4A, 4B, 4C, and 4D are the various components of the power translating mechanism 30. These include shaft member 31 with shaft mounted rotatable member 32, and a force transmitting means comprising axle members 33, mechanism mounted rotatable members 34, and a tether means. A tether means, such as a belt, cable, chain, etc., is used to connect the mechanism mounted rotatable members 34 with the foot engagement members 20, and to shaft mounted rotatable member 32, if a shaft is included. Mechanism mounted rotatable members 34 may be rigidly mounted upon axle members 33, which may be rotatably mounted through axle openings 16 of mechanism mounts 15. If a shaft member 31 is to be utilized, it will turnably mount through shaft openings 17 of mechanism mounts 15. Shaft mounted rotatable member 32 would thus rigidly mount on shaft member 31, one at each end, each in the proximate same plane as the corresponding mechanism mounted rotatable members 34.

Figure 5A:
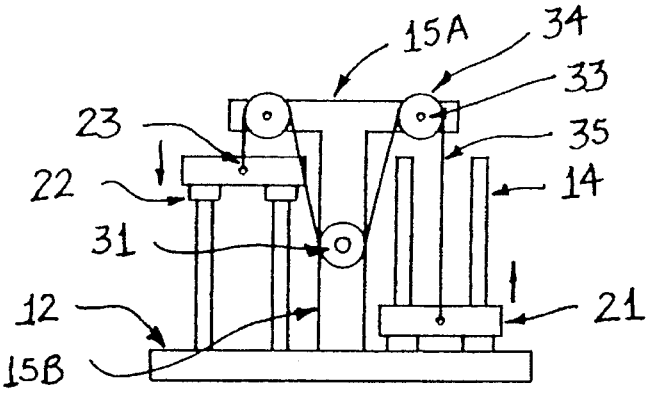
FIG. 5A is a front view of the side stepping exercise apparatus demonstrating one of the operating positions of the apparatus.
Figure 5B:
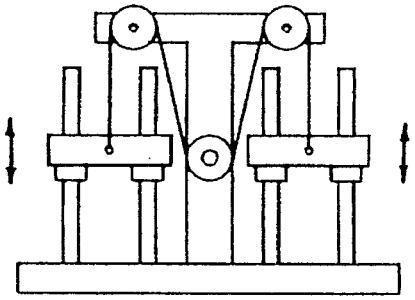
FIG. 5B is another front view of the side stepping exercise apparatus demonstrating another operating position.
Figure 5C:
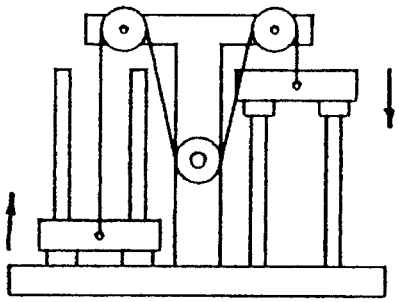
FIG. 5C is another front view of the side stepping exercise apparatus demonstrating another operating position.

FIGS. 5A, 5B, and 5C demonstrate from one side view the operation of the side stepping exercise apparatus by showing different operating positions of the apparatus. The other side of the apparatus would be configured identically. As seen, the foot engaging members 21 will slide upward and downward in a substantially vertical direction along guide members 14. Guide bearings, which may be a type of sliding, rolling, or ball bearing, may be placed in the guide openings 22 to assist with the sliding motion. At least one guide member 14 should be coupled to each end of the foot engaging member 21 to keep the member in a substantially horizontal position as it moves upward and downward. The drawings demonstrate two guide members 14 at each end and this will probably prove to provide better guidance than having only one.

As seen, when a shaft is utilized, the foot engaging members 21 are connected to shaft member 31 through tether means 35, mechanism mounted rotatable members 34, and shaft mounted rotatable members 34. Shaft member 31 is turnably mounted to mechanism mount 15 through shaft opening 17. A shaft bearing, such as a bushing or ball bearing, may be placed within shaft opening 17 to allow easier rotation. As seen, the tether means 35 is connected at one end to the foot member connectors 23 of the first foot engagement means 20. The tether means 35 then runs upward and over the first mechanism mounted rotatable member 34, then downward and under the shaft mounted rotatable member 32. The tether means 35 then runs upward and over the second mechanism mounted rotatable member 34, and then downward to connect to the foot member connector 23 of the second foot engaging member 21. This configuration will cause the foot engaging members 21 to move in opposite vertical direction of one another, with shaft member 31 turning simultaneously.

When a shaft is not utilized, the configuration may be like that shown in FIG. 1D. The tether means 35 loops up and over the first mechanism mounted rotatable member 34 from the foot member connector 23 of the first foot engaging member 21. From here, the tether runs across and over the second mechanism mounted rotatable member 34, then runs downward where it connects with the foot member connector 23 of the second foot engaging member 21. This configuration will also cause the foot engaging members 21 to move in opposite vertical direction of one another.

As may be visualized by FIGS. 5A, 5B, and 5C, the downward motion of one foot engaging member 21 will correspond with an upward motion in the second foot engaging member 21, since they are connected by tether means 35. If shaft member 31 is to be utilized, then it may connect to tether means 35 via shaft rotatable member 32. Therefore shaft member 31 will turn backward and forward as foot engaging members 21 move upward and downward, and vice versa.

Figure 6A:
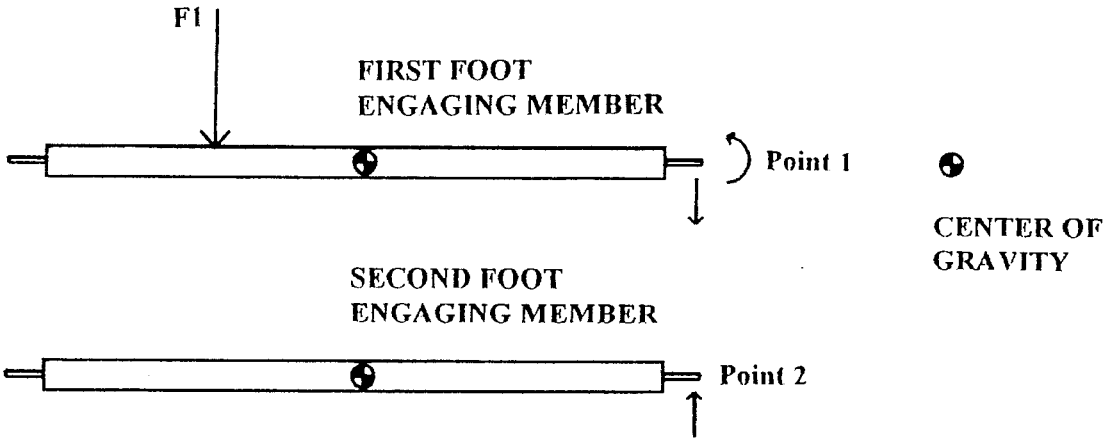
FIG. 6A is a side view of the foot engagement means demonstrating how a significant moment is created when only one end or the sides of the foot engaging member is guided, supported, and acted upon by a force.
Figure 6B:
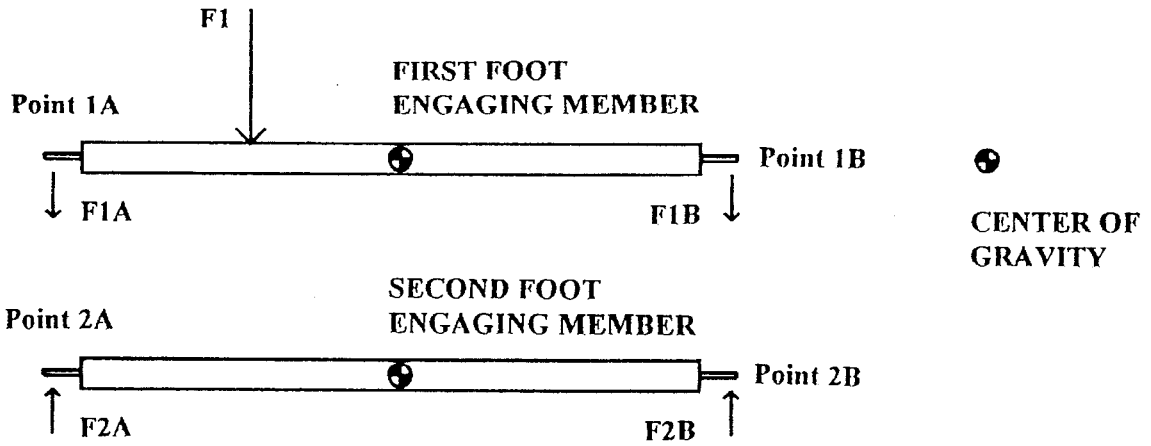
FIG. 6B is a side view of the foot engagement means demonstrating how a significant moment is not created when each end of the foot engaging member is guided, supported and acted upon by forces.

As may be seen in FIGS. 6A and 6B, it is better to have both ends of the foot engaging member supported and guided, and have forces acting upon both ends of the member. As seen in FIG. 6A, when a force is exerted downward upon the first foot engaging member which is supported and guided along one end or along the side, a moment will be created about the end being supported and guided. This moment causes an increase in the amount of friction experienced by the guide/support member. Therefore the force transmitted by the power translating mechanism to the second foot engaging member is much less than the original force exerted downward upon the first foot engaging member. This increase in friction also makes downward movement of the first engaging member much harder and slower.

FIG. 6B demonstrates how a foot engaging member supported and guided at both the front and rear ends create a more balanced and smoother movement. When a force F1 is exerted on the first foot engaging member by the user, it is divided into components F1A and F1B. Having guides at both ends greatly reduces the moment caused by the applied force F1. Since the moment created by the original force will be relatively small and the first foot engaging member will remain substantially horizontal, the component forces F1A and F1B will have a similar magnitude and their total magnitude will be close to that of the original force. Therefore, the forces exerted on the ends of the second foot engaging member, F2A and F2B, will have similar magnitudes to F1A and F1B, and the second foot engaging member will move upward along the guides fairly easily.

Figure 6C:
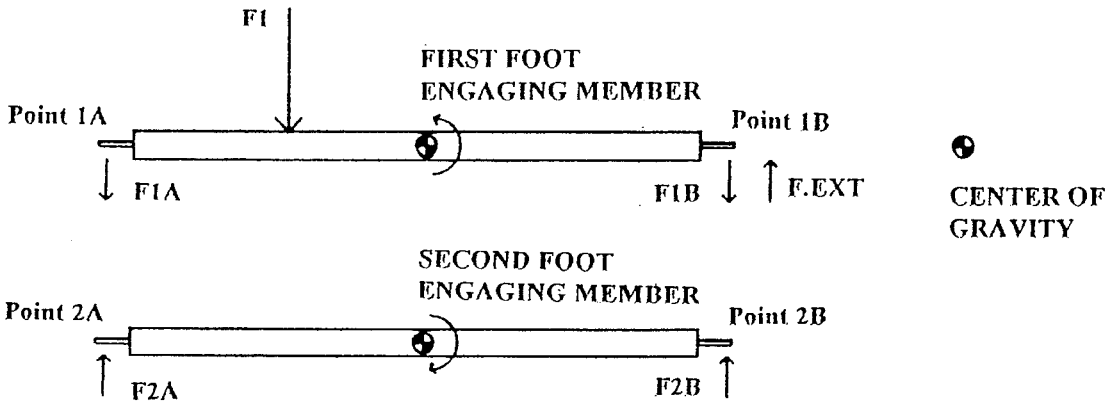
FIG. 6C is a side view of the foot engagement means demonstrating how an external force applied to the foot engaging member at one end creates a significant moment.
Figure 6D:
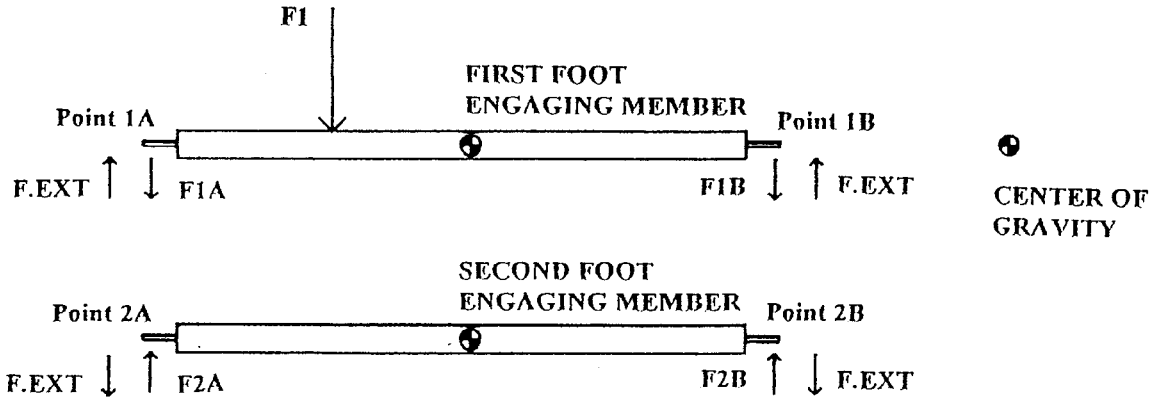
FIG. 6D is a side view of the foot engagement means demonstrating how and external force applied to the foot engaging member at both ends does not create a significant moment.

FIGS. 6C and 6D demonstrate how external forces applied to the foot engaging members effect their movement. As explained by FIGS. 6A and 6B, it is desireable to have both ends of the foot engaging members moveably supported and guided. It is also desireable to have external forces exerted at both ends and be of equal magnitude. This is shown and explained in FIGS. 6C and 6D. As seen in FIG. 6C, if an external force F.EXT is applied to only one end, a moment will again be created, which increases the friction against the guide members, and therefore makes movement much harder. When the external force is equally applied to both ends, as in FIG. 6D, a moment is not created and there is no additional friction resulting from the external force.

As stated previously, an optional shaft member may be part of the power translating mechanism. The purpose of a shaft member is to allow forces to be equally exerted at each end of the foot engaging members. When a resistance means is connected to the shaft member, the resistance force is equally applied at each end of the foot engaging members. Similarly, when a motor means is connected to the shaft member, the force exerted by the motor is also equally distributed at each end of the foot engaging member. Therefore, the force applied by the user is acted against by the resistant or motor forces at the ends of the foot engaging member, minimizing the effort of the foot engaging member to tilt one way or the other. The more the foot engaging members try to tilt, the more friction exist and the harder it is for the foot engaging members to move upward and downward along the guide members. This balancing of forces reduces the tilting effort of the foot engaging members and therefore makes upward and downward movement much easier. In the preferred embodiment, the power translating mechanism would be comprised of both the force transmitting means and the shaft member.

A desireable feature of the foot engaging members may be that they have sufficient length so that the user may simulate forward and backward stepping. The user may place one foot towards the front of one of the first foot engaging members and the other foot towards the back of the second foot engaging member. By stepping while in this position, the user creates a forward and backward stepping routine, which is not found on any other stepping devices. The user may then reverse feet position and perform the stepping routine again. Having an apparatus with a shaft member would allow for easier movement of the foot engaging members when performing this routine, and also allow better application of external forces.

As mentioned previously, a generally inverted U-shaped hand engagement means 25 may be part of the apparatus and may serve several purposes. It may be used to assist the user in maintaining proper balance, and it may also be used to provide an upper body workout. The hand engagement means is shown in FIGS. 7A–7D and may comprise a hand engagement handle 26 with two downwardly extending handle support members 27 having handle support holes 28. These members may be tubular structures containing handle support holes 28 through the side and located at the end of each handle support member 27. Also part of the hand engagement means 25 may be handle mounts 29, which have handle mount holes 30 also through the side. The handle mounts 29 may also be tubular in design and may be rigidly mounted on structural frame means 11 along one of the cross support members 13, or may be mounted on the foot engaging member 21 of foot engagement means 20, or both locations.

Figure 7A:
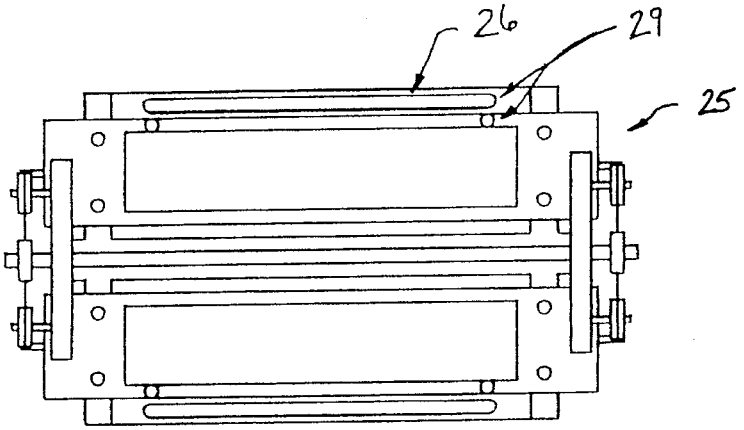
FIGS. 7A, 7B, and 7C are top, side, and front views, respectively, of the side stepping exercise apparatus utilizing a hand engagement means.
Figure 7D:
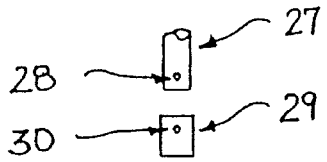
FIG. 7D is a side view of the side stepping exercise apparatus demonstrating the mounting of the hand engagement means.
Figure 7B:
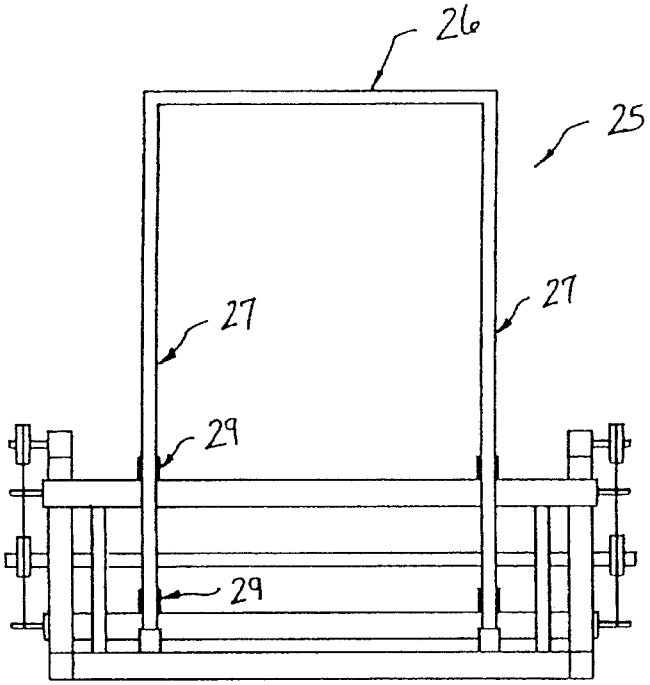
Figure 7C:
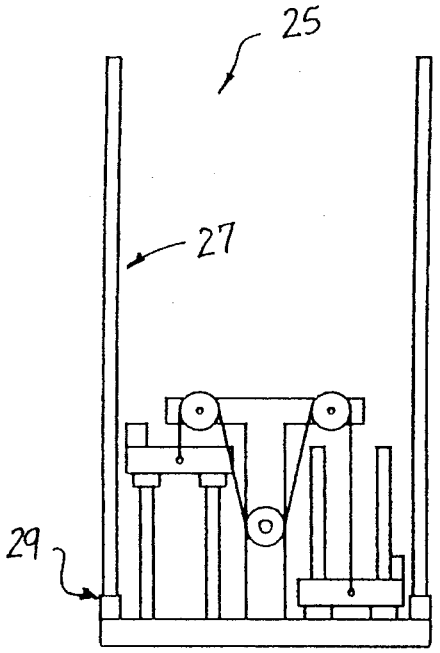

As seen in FIG. 7D, each end of handle support member 27 contains a hole 28 through the side. The handle mount 29 also has holes 30 through its side. Handle mount 29 has a larger diameter than the handle support members 27, thereby allowing handle support members 27 to slideably fit within. Once inside, the holes are aligned and the members and mounts are secured together through some type of securing means such as a pin or bolt. When the hand engagement handle 26 is mounted to the cross support member 13, it may be used primarily for balancing purposes. When the hand engagement handle 26 is mounted to the foot engaging member 21, it may be used primarily as an upper body workout device, in that the user will be able to produce downward motion in the foot engaging member 21 both with their foot and with their hand.

Figure 8A:
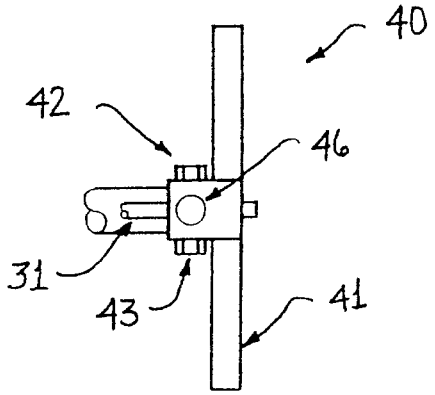
FIGS. 8A, 8B, and 8C are top, side, and front views, respectively, of a resistance means which may be used in conjunction with the side stepping exercise apparatus.
Figure 8C:
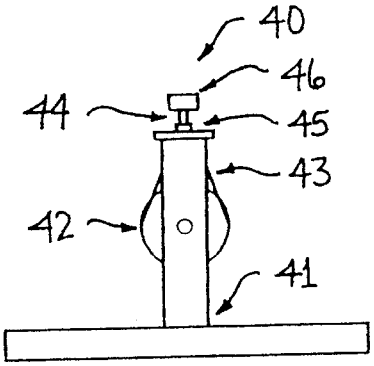
Figure 8B:
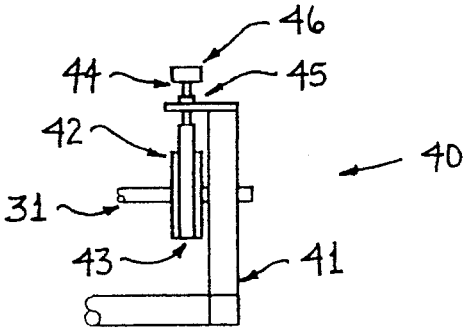

As may be seen in FIGS. 8A–8C, a resistance means 40 may also be part of the apparatus to provide a resistance in the upward and downward movement of the foot engaging members. The resistance means 40 may be a commonly seen type of resistance device which may comprise a resistance mount 41, a circular member 42, a friction belt 43, a threaded shaft 44, a threaded opening 45, and a knob means 46. The resistance mount 41 may connect to the structural frame means 11 or may be a part of it. The resistance mount 41 may contain a threaded opening 45 through which a threaded shaft 44 turns. The threaded shaft 44 has a knob means 46 fixedly mounted on one end which is used to turn the threaded shaft. Loosely connected to the other end of the threaded shaft 44 is a friction belt 43, which does not turn as the knob is turned. The friction belt 43 may be an endless belt which extends around at least a portion of the periphery of a circular member 42. The circular member 42 may be rigidly mounted upon shaft member 31 of the power translating mechanism 30, and will turn simultaneously with shaft member 31. If a shaft member is not utilized, it would be possible to rigidly mount the circular member to a mechanism rotatable member 34, but would therefore provide resistance to only one end of the foot engaging members 21 and thus would not allow for a very balanced apparatus, although the apparatus might still function. Therefore a shaft member 31 would provide balance and be in the better embodiment.

As the user pushes downward upon the foot engaging member 21 of the foot engagement means 20, motion will occur in the circular member 42. The amount of force exerted by the friction belt 43 upon the circular member 42 will correspond to the amount of resistance encountered by the user as they push downward upon the foot engaging member 21. The amount of force exerted by the friction belt 43 may be adjusted through knob means 46. When the knob means 46 is turned in one direction, the threaded shaft 44 will turn accordingly and move upward, causing the friction belt 43 to tighten against the circular member 42, increasing the resistance force. Upon turning the knob in the other direction, the belt will loosen, thereby decreasing the resistance force.

Figure 9A:
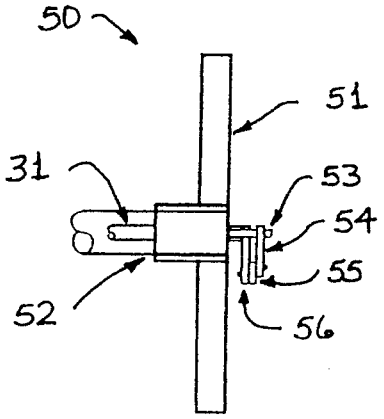
FIGS. 9A, 9B, and 9C are top, side, and front views, respectively, of a motor means which may be used in conjunction with the side stepping exercise apparatus.
Figure 9C:
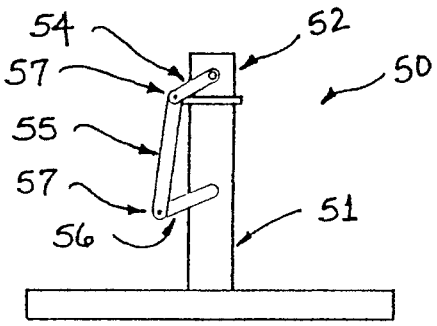
Figure 9B:
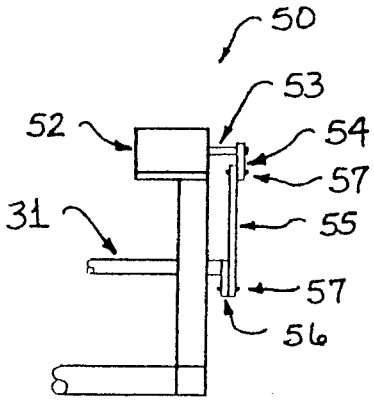

As shown in FIGS. 9A–9C, a motor means 50 which may be used in conjunction with the shaft member 31 of the power translating mechanism 30 to produce automatic motion in the foot engaging members 21. The motor means 50 may comprise a motor mount 51, a motor 52 having a motor shaft 53, and a rocker-link crank assembly comprising a crank link 54, coupler link 55, and rocker link 56. The links may be pivotally connected together using linkage connectors 57. The motor 52 may mount upon a motor mount 51, and the crank link 54 is rigidly mounted to the motor shaft 53. The rocker link 56 is rigidly mounted to shaft member 31 of power translating mechanism 30. The coupler link 55 connects the crank link 54 and rocker link 56 together. Therefore as the motor shaft 53 rotates, so will the crank link 54. As the crank link 54 rotates, the rocker link 56 will rock backward and forward, causing shaft member 31 to rotate backward and forward. The motion of shaft member 31 will turn shaft mounted rotatable members 32 backward and forward, causing tether means 35 to move backward and forward. The tether means 35 will cause foot engaging members 21 to move correspondingly upward and downward automatically. The degree to which shaft member 31 rotates backward and forward is dependent upon the length of the crank, coupler, and rocker links. By altering their lengths or changing the points at which the links are connected together, the user may change the amount of rotation in shaft member 31 and thus change the levels to which the foot engaging members 21 move upward and downward.

There are many examples of force transmitting means which perform the same function of the tether means and the mechanism mounted rotatable members. Their function is to connect the two foot engaging members in such a manner that downward force and motion in one of the members will be transmitted into upward force and motion in the second member. The upward and downward motion of the foot engaging members will also correspond to a back and forth turning motion in the shaft member, if a shaft member is utilized. Examples of these force transmitting means include a pulley and cable system, a chain and sprocket system, and a belt and roller system. If a resistance or motor means is to be utilized and thus a shaft member, the best assembly would be a chain and sprocket assembly. As may be seen in the parent application, many types of lever systems may be designed to serve as a force transmitting means. Seen in the prior art are types of hydraulic and pneumatic systems which can also serve as force transmitting means.

While it will be apparent that the preferred embodiment of the invention herein is well-calculated to fulfill the objects above stated, it will be appreciated that the invention is susceptible to modification, variation, and change without departing from the proper scope or fair meaning of the subjoined claims.

I claim:

1. An exercise apparatus comprising:

a structural frame means, two foot engaging members, both coupled to said structural frame means to move in a substantially vertical direction;

a shaft member turnably mounted to said structural frame means;

one force transmitting means operatively connecting the front portion of one foot engaging member, the front portion of the second foot engaging member, and the front portion of said shaft member, a second force transmitting means operatively connecting the rear portion of one foot engaging member, the rear portion of the second foot engaging member, and the rear portion of said shaft member, each force transmitting means being used to transmit the downward force applied to a portion of one foot engaging members into an upward force on the corresponding portion of the second foot engaging member, thereby moving said foot engaging members in opposite direction from one another, whereby the user may perform a stepping exercise routine whereby the feet of the user move opposite one another in a substantially vertical direction.

2. The exercise apparatus as claimed in claim 1, wherein said structural frame means comprises:

a rigid frame; and guide members mounted to said rigid frame, said guide members being mounted near the front and rear of said rigid frame, each guide member having an elongated structure extending in a substantially vertical direction.

3. The exercise apparatus as claimed in claim 2, wherein each of said foot engaging member comprises:

a relatively flat structure upon which a user places a foot while in a standing position; and guide openings extending in a substantially vertical direction through said flat structure, at least one guide opening located near the front of said flat structure and loosely receiving one of said guide members mounted near the front of said rigid frame of said structural frame means, and at least one other guide opening located near the rear of said flat structure and loosely receiving one of said guide members mounted near the rear of said rigid frame of said structural frame means, thereby coupling said foot engaging member to said structural frame means such that said foot engaging member maintains a substantially horizontal position while moving in a substantially vertical direction.

4. The exercise apparatus as claimed in claim 1, wherein each of said force transmitting means comprises a tether means and a pulley wheel means, said pulley wheel means mounted on said structural frame means, said tether means in contact with and moving on said pulley wheel means, said foot engaging members connected to said tether means so that a downward force applied to a portion of one foot engaging member produces an upward force upon the corresponding portion of the second foot engaging member.

5. The exercise apparatus as claimed in claim 4, said shaft member having a pulley wheel means mounted near the front and a pulley wheel means mounted near the rear, said pulley wheels means in contact with a corresponding tether means of said force transmitting means, such that upward and downward motion in said foot engaging members corresponds with a back and forth turning motion in said shaft member.

6. The exercise apparatus as claimed in claim 4, said tether means and said pulley wheel means is a chain and sprocket.

7. The exercise apparatus as claimed in claim 5, said pulley wheel means of said shaft member is a sprocket.

8. The exercise apparatus as claimed in claim 1, further comprising a resistance means operatively connected to said shaft member for producing a resistance force against the motion of said foot engaging members.

9. The exercise apparatus as claimed in claim 8, said resistance means comprising:

a resistance mount connected to said rigid frame of said structural frame means and having a threaded opening;

a threaded shaft turnably supported by said threaded opening;

a knob rigidly mounted to one end of said threaded shaft;

a rotatable member rigidly mounted to said shaft member;

a friction belt loosely connected at one end to said threaded shaft and extending around at least a portion of the periphery of said rotatable member, whereby turning said knob in one direction will tighten said friction belt around said rotatable member, causing an increase in resistance to movement of said foot engaging members, and turning said knob in the opposite direction loosens said friction belt and causes a decrease in resistance.

10. The exercise apparatus as claimed in claim 1, further comprising a motor means operatively connected to said shaft member for producing automatic movement of said foot engaging members in the upward and downward direction.

11. The exercise apparatus as claimed in claim 10, said motor means comprising:

a motor mount connected to said rigid frame of said structural frame means and used to support a motor having motor shaft;

a crank link rigidly mounted to said motor shaft;

a rocker link rigidly mounted to said shaft member of said power translating mechanism;

a coupler link loosely connecting said crank link and said rocker link for translating the rotary motion of the motor shaft into upward and downward movements of said foot engaging members for automatic operation of said apparatus.

12. An exercise apparatus comprising:

a structural frame means;

two foot engaging members, both coupled to said structural frame means to move in a substantially vertical direction; and one force transmitting means operatively connecting the front portion of one foot engaging member, the front portion of the second foot engaging member, and the front portion of said structural frame means; a second force transmitting means operatively connecting the rear portion of one foot engaging member, the rear portion of a second foot engaging member, and the rear portion of said structural frame means; each force transmitting means being used to transmit the downward force applied to a portion of one foot engaging members into an upward force on the corresponding portion of the second foot engaging member, thereby moving said foot engaging members in opposite direction from one another, whereby the user may perform a stepping exercise routine whereby the feet of the user move opposite one another in a substantially vertical direction;

each of said force transmitting means comprises a tether means and a pulley wheel means, said pulley wheel means mounted on said structural frame means, said tether means in contact with and moving on said pulley wheel means, said foot engaging members connected to said tether means so that a downward force applied to a portion of one foot engaging member produces an upward force upon the corresponding portion of the second foot engaging member.

13. The exercise apparatus as claimed in claim 12, wherein said structural frame means comprises:

a rigid frame; and guide members mounted to said rigid frame, said guide members being mounted near the front and rear of said rigid frame, each guide member having an elongated structure extending in a substantially vertical direction.

14. The exercise apparatus as claimed in claim 13, wherein each of said foot engaging member comprises:

a relatively flat structure upon which a user places a foot while in a standing position; and guide openings extending in a substantially vertical direction through said flat structure, at least one guide opening located near the front of said flat structure and loosely receiving one of said guide members mounted near the front of said rigid frame of said structural frame means, and at least one other guide opening located near the rear of said flat structure and loosely receiving one of said guide members mounted near the rear of said rigid frame of said structural frame means, thereby coupling said foot engaging member to said structural frame means such that said foot engaging member maintains a substantially horizontal position while moving in a substantially vertical direction.

15. The exercise apparatus as claimed in claim 12 further comprising a shaft member turnably mounted on said structural frame means, said shaft member having a pulley wheel means mounted near the front and a pulley wheel means mounted near the rear, said pulley wheels means in contact with a corresponding tether means of said force transmitting means, such that upward and downward motion in said foot engaging members corresponds with a back and forth turning motion in said shaft member.

16. The exercise apparatus as claimed in claim 15, said tether means and said pulley wheel means is a chain and sprocket.

17. The exercise apparatus as claimed in claim 15, further comprising a resistance means operatively connected to said shaft member for producing a resistance force against the motion of said foot engaging members.

18. The exercise apparatus as claimed in claim 17, said resistance means comprising:

a resistance mount connected to said rigid frame of said structural frame means and having a threaded opening;

a threaded shaft turnably supported by said threaded opening;

a knob rigidly mounted to one end of said threaded shaft;

a rotatable member rigidly mounted to said shaft member;

a friction belt loosely connected at one end to said threaded shaft and extending around at least a portion of the periphery of said rotatable member, whereby turning said knob in one direction will tighten said friction belt around said rotatable member, causing an increase in resistance to movement of said foot engaging members, and turning said knob in the opposite direction loosens said friction belt and causes a decrease in resistance.

19. The exercise apparatus as claimed in claim 15, further comprising a motor means operatively connected to said shaft member for producing automatic movement of said foot engaging members in the upward and downward direction.

20. The exercise apparatus as claimed in claim 19, said motor means comprising:

a motor mount connected to said rigid frame of said structural frame means and used to support a motor having motor shaft;

a crank link rigidly mounted to said motor shaft;

a rocker link rigidly mounted to said shaft member of said power translating mechanism;

a coupler link loosely connecting said crank link and said rocker link for translating the rotary motion of the motor shaft into upward and downward movements of said foot engaging members for automatic operation of said apparatus.

* * * * *